US005325644A

United States Patent [19]

Cornelius

[11] Patent Number: 5,325,644

[45] Date of Patent: Jul. 5, 1994

[54] POOL WALL CONSTRUCTION

[76] Inventor: Kerry J. Cornelius, 40 Leeson Street, St. Catharines, Ontario, Canada, L2T 2R4

[21] Appl. No.: 926,704

[22] Filed: Aug. 10, 1992

[51] Int. Cl.[5] ..... E04H 3/16

[52] U.S. Cl. ..... 52/169.7; 4/506; 248/459; 52/169.8

[58] Field of Search ..... 52/169.7, 169.8, 169.9, 52/250, 245; 4/506, 488; 249/3, 6, 13, 40, 41, 44, 47, 48, 50; 248/174, 152, 459; 405/285, 286, 287

[56] References Cited

U.S. PATENT DOCUMENTS

| | | | |
|---|---|---|---|
| 3,016,546 | 1/1962 | Lerner | 4/172 |
| 3,106,045 | 10/1963 | Rautio | 50/100 |
| 3,371,455 | 3/1968 | Fox | 52/169 |
| 3,416,165 | 4/1969 | Adam et al. | 52/169 |
| 3,428,969 | 5/1969 | Shanni | 52/149 |
| 3,440,780 | 8/1969 | Michalke et al. | 4/172 |
| 3,444,659 | 5/1970 | Fox | 52/146 |
| 3,458,875 | 2/1971 | Arp | 52/169 |
| 3,511,002 | 5/1971 | Barker | 4/172.19 |
| 3,564,791 | 8/1972 | Gerring | 4/172.19 |
| 3,579,665 | 6/1973 | Posnick | 52/169 |
| 3,686,694 | 6/1974 | Rozanski | 4/172.19 |
| 3,739,539 | 8/1976 | Witte et al. | 52/169 R |
| 3,820,174 | 5/1978 | Price | 52/169.7 |
| 3,975,874 | 8/1978 | Cornelius | 4/172.19 |
| 4,090,266 | 11/1980 | Bumgarner | 52/169.7 |
| 4,109,324 | 12/1968 | Pereira | 4/172 |
| 4,232,491 | 2/1969 | Diemond et al. | 4/172 |
| 4,330,102 | 5/1982 | Gebhardt et al. | 248/459 |
| 4,473,978 | 10/1984 | Wood | 4/506 |
| 4,635,304 | 1/1987 | Zikmanis et al. | 4/506 |
| 4,666,334 | 5/1987 | Karaus | 405/287 |
| 4,781,000 | 11/1988 | Bertsch et al. | 52/169.8 |
| 4,797,957 | 1/1989 | Weir et al. | 4/506 |
| 4,846,437 | 7/1989 | Fitzgerald | 249/6 |
| 5,025,601 | 6/1991 | Hand | 52/169.7 |
| 5,054,135 | 10/1991 | Dallaire et al. | 4/506 |

FOREIGN PATENT DOCUMENTS 1035502 8/1978 Canada .

*Primary Examiner*—Carl D. Friedman
*Assistant Examiner*—Winnie Yip
*Attorney, Agent, or Firm*—Vickers, Daniels & Young

[57] ABSTRACT

A concrete form and a pool wall and deck support system is disclosed. The pool wall may be formed of steel, plastic, aluminum or wood and has a plurality of wall panels secured together in end-to-end relation to define the perimeter of the structure. Wall supports or brace structures fabricated from non-compressible material such as concrete are attached to, and support both the wall of the pool and the perimeter deck therearound. The pool wall, coping and deck are supported by the top of the concrete brace structure. In a preferred embodiment, the brace structure is fabricated from pairs of nestable forms made from a suitable material such as corrugated cardboard and are located beside the pool walls, reinforcing bars are attached to the pool walls and interconnect the latter with the walls and the forms are filled with concrete and are so structured as to have the concrete engage the flanges of the pool wall panels.

2 Claims, 7 Drawing Sheets

POOL WALL CONSTRUCTION

FIELD OF THE INVENTION

This invention relates to swimming pool construction and in particular to an improved brace structure and pool wall and deck support system.

BACKGROUND OF THE INVENTION

Conventionally, mechanisms for strengthening swimming pool walls have generally consisted of metal bracings, sometimes in the form of a "X" as shown for example in U.S. Pat. No. 4,797,957. Another example is my earlier U.S. Pat. No. 4,109,324 where I disclose a combination of an X-shaped brace filled with concrete, the brace having extensions that bolt on to the outside of the pool wall. Other examples of the prior art may be found in U.S. Pat. No. 4,781,000 Nov. 1, 1988; U.S. Pat. No. 4,635,304 Jan. 13, 1987; and U.S. Pat. No. 4,232,491 of Nov. 11, 1980. Several Canadian Patents may also be referred to, 1,266,352 Mar. 6, 1990; 1,169,330 Jun. 19, 1984; and 1,189,658 Jul. 2, 1985.

The present invention provides an improved wall brace and support system and incorporates concrete form units that are constructed in such a manner that, when completed, concrete in the form attaches directly to the pool wall so that a solid concrete brace is attached to the pool wall and also supports a poured concrete deck around the upper edge thereof. This is a distinct concept compared to many conventional arrangements where sono tubes, plastic or steel forms are used and in which a plastic or steel membrane interconnects the wall structure to the concrete.

The invention provides a pool wall bracing and support system in which a concrete structure is poured in place and attaches to the steel or plastic wall of the swimming pool and supports the wall and, if required, a poured concrete deck which surrounds all or part of the pool.

The pool wall may be formed of steel, plastic, aluminum or wood and has a plurality of wall panels secured together in end-to-end relation to define the perimeter of the pool wall structure. Wall supports or brace structures according to the invention include form units fabricated from any suitable material and in a preferred embodiment this material is a double walled, waxed corrugated cardboard. The form units are located at predetermined spacings in the excavation around the outside of the pool wall. The form units are so constructed as to have portions at least of the flanges of the walls enter the confines of the forms so that when the forms are filled with concrete, the concrete attaches directly to the flanges of the walls. This provides a much more stable and stronger brace and spreads the load of support more evenly across the panels of the walls than in conventional systems.

According to one broad aspect, the invention relates to a swimming pool wall structure comprising a plurality of pool wall panels secured together in end-to-end relation to define the perimeter of the pool. Flanges are provided on the terminal end edges of each of the panels for securement to juxtaposed flanges on adjoining panels and the flanges extend generally normal to and outwardly of the pool wall. A plurality of pool wall support and brace members are spaced about the outer perimeter of the wall structure and each of the brace members comprises a concrete form configured to accept at least portions of the flanges of the panels so that when concrete is poured into the forms, the concrete encompasses those portions of the flanges within the confines of the forms.

According to another broad aspect, the invention relates to a concrete form unit for use as a bracing and supporting member for a swimming pool wall, the form unit comprising front and rear walls spaced by side walls connected thereto and defining open ends of the form unit. End panels are coplanar with and extend outwardly of one end of the front and rear walls for slidably receiving like panels on a corresponding open end of another form unit and a slot is provided in one of the end walls for receiving flanges projecting from panels of the pool wall.

According to a still further aspect, the invention relates to an erectable, blank concrete form unit for use as a bracing and supporting member for a swimming pool wall. The blank comprises a plurality of foldable panels including primary front and rear panels, a secondary panel interconnected to the primary panels by parallel lines of weakness and, when erected, forms a first end wall spacing the front and rear wall panels; and a pair of tertiary panels each of which is connected to a side edge of the primary panels by a line of weakness and, when erected, serving to space the primary front and rear panels and constituting a second end wall of the form. Spaced tongues are provided on the terminal side edges of the tertiary panels and slots are located inwardly of the tongues adjacent the lines of weakness between the tertiary panels and the primary panels, the slots of tertiary panel receiving the tongues of the other tertiary panel when the blank is erected to close and secure the second end wall.

BRIEF DESCRIPTION OF THE DRAWINGS

The invention is illustrated, by way of example, in the accompany drawings in which.

DESCRIPTION OF THE PREFERRED EMBODIMENT

Figure 1:
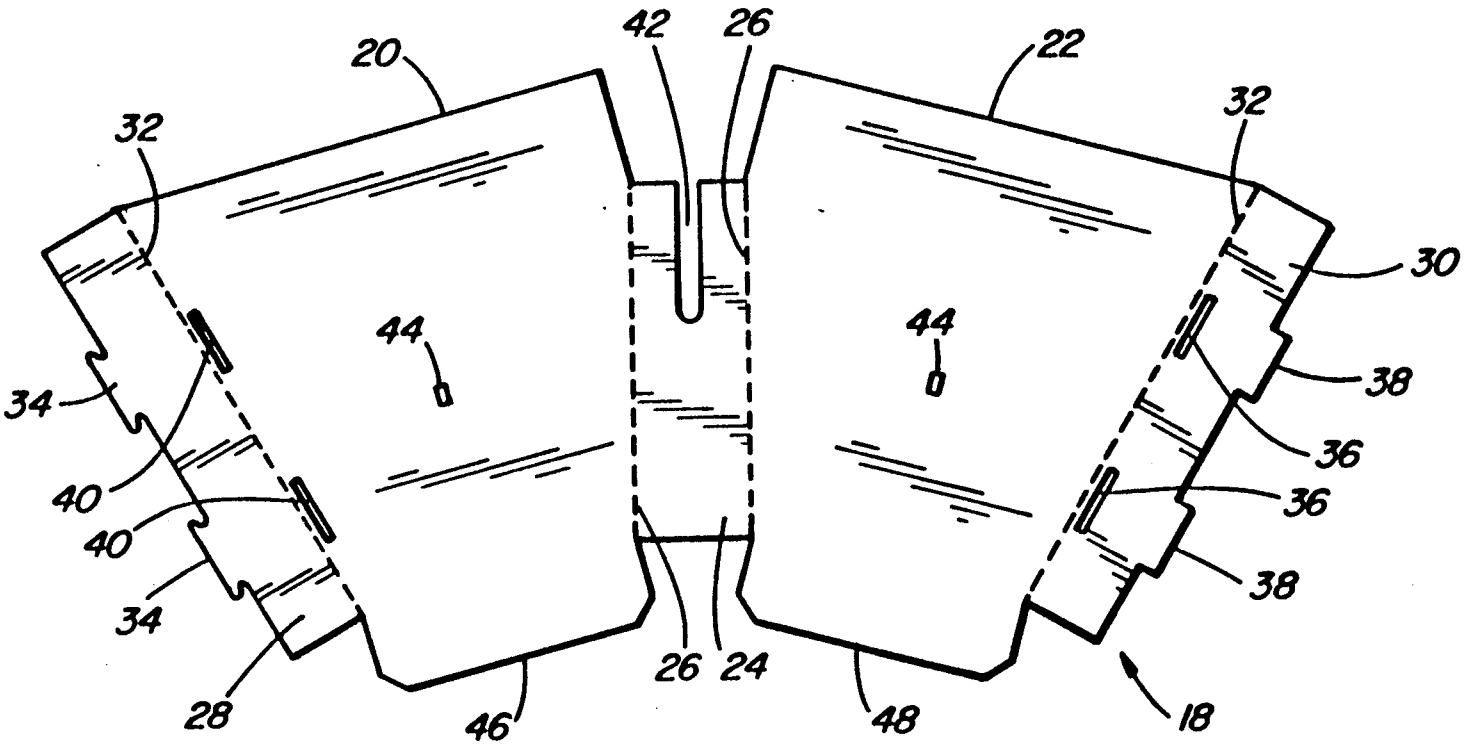
FIG. 1 is a plan view of an erectable, blank form unit.
Figure 2:
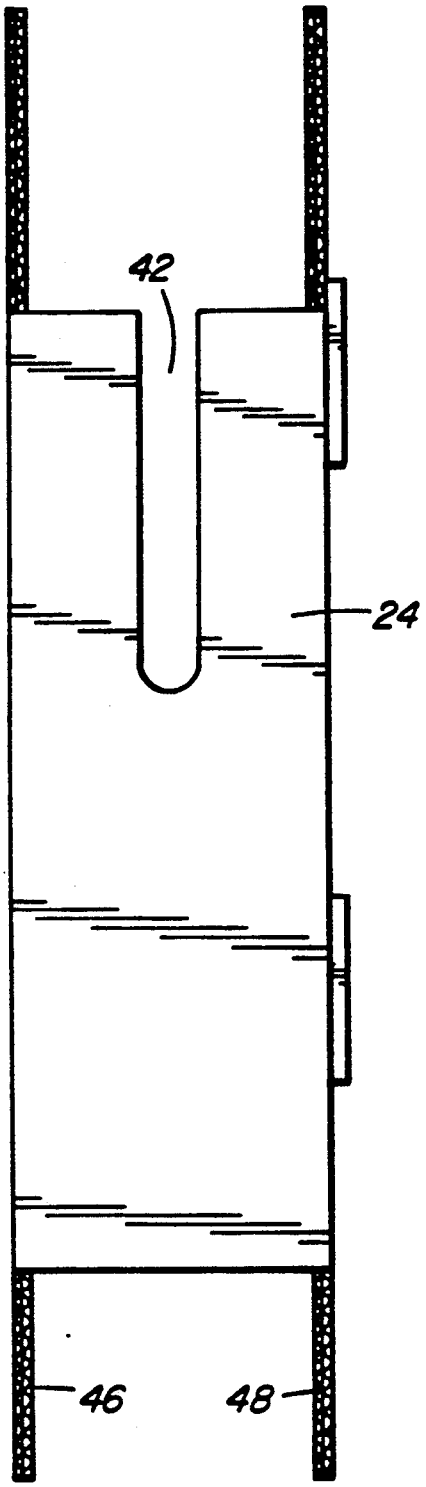
FIG. 2 is a left side view of an erected blank.
Figure 3:
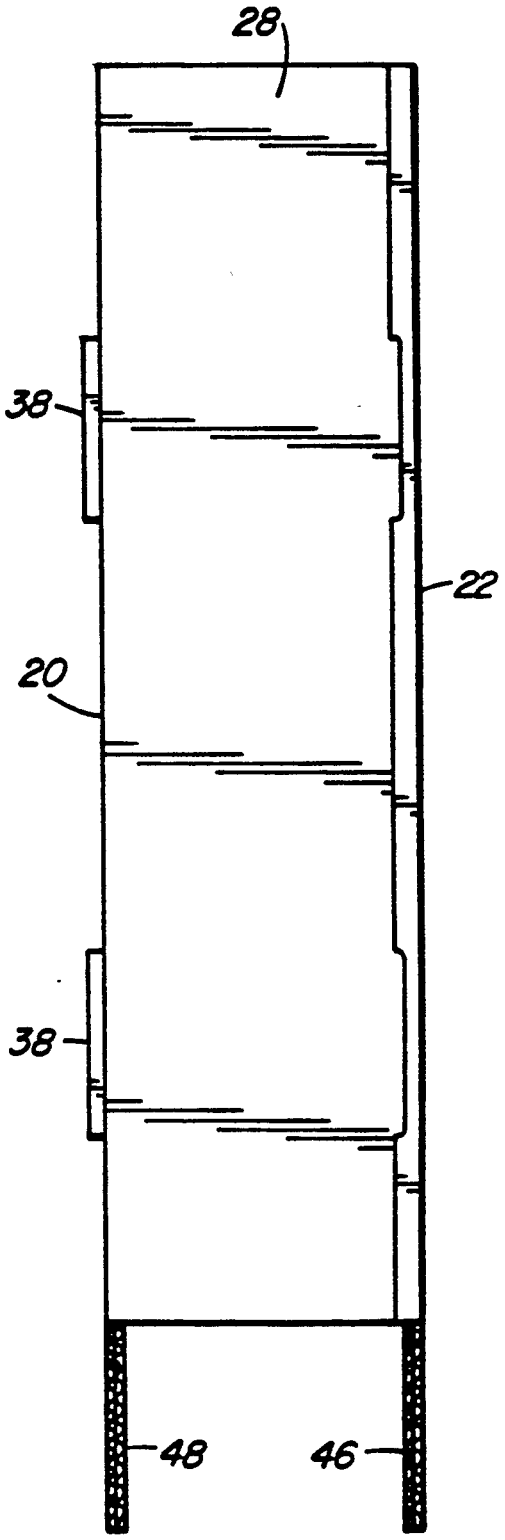
FIG. 3 is a right side view of the erected blank.
Figure 4:
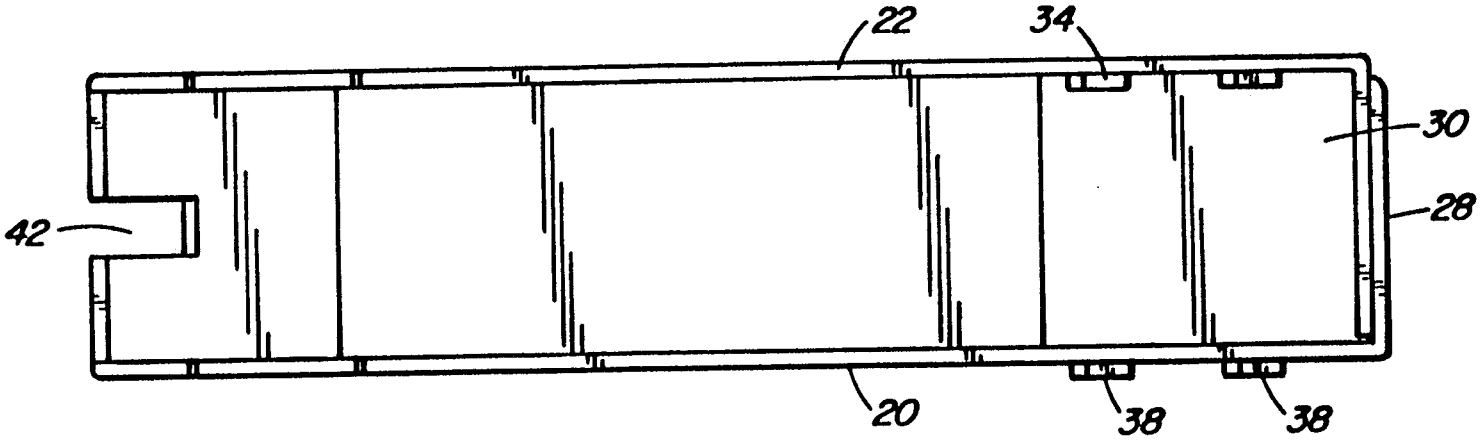
FIG. 4 is a top view of an erected blank.
Figure 5:
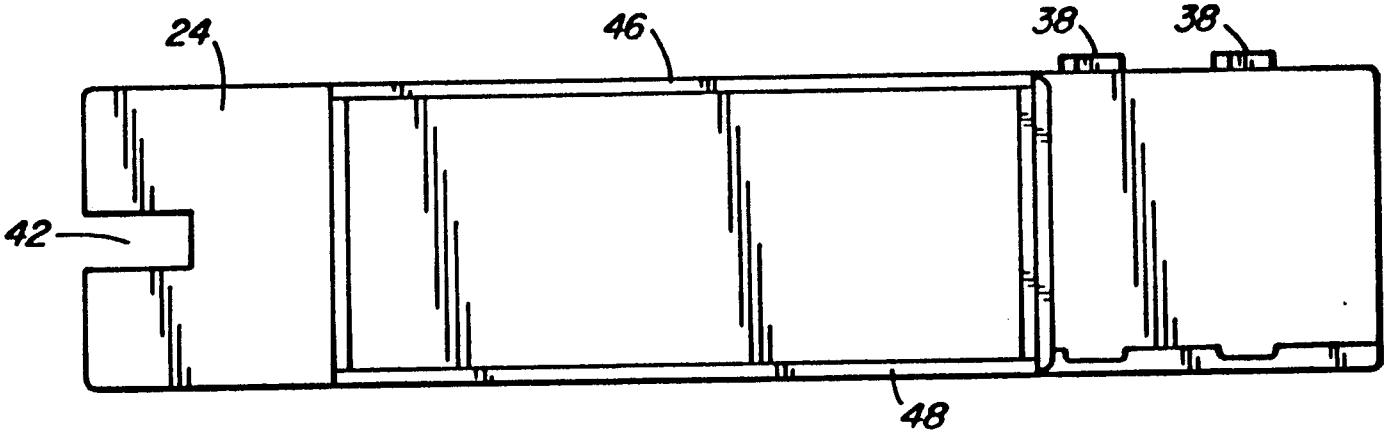
FIG. 5 is a bottom view of the erected blank form.
Figure 6:
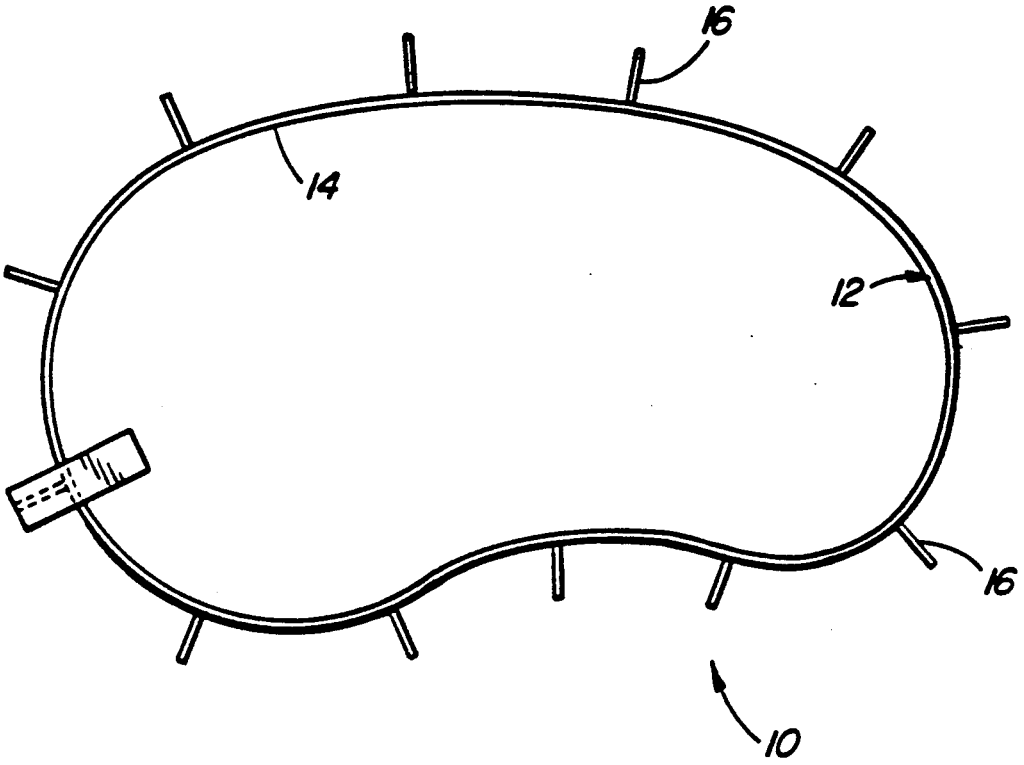
FIG. 6 is a schematic plan view of a kidney shaped swimming pool layout.

Referring initially to FIG. 6, a kidney-shaped swimming pool is indicated generally at 10 and it includes a wall 12 comprising a plurality of panels 14 which, in the illustrated case, form a sinuous line to define the "kidney" configuration. The panels 14 of the pool wall 12 are supported at spaced intervals by pool wall support and brace members 16.

The pool wall support and brace members 16 each consists of forms that are located in position relative to the pool wall and then filled with concrete as will be subsequently described. The forms according to the present invention can be manufactured from any suitable, strong material and in the embodiment of the invention illustrated herein, that material is double walled, waxed corrugated cardboard. The form can assume various configurations so long as it is adaptable to the functional requirements of the present invention and in the illustrated embodiment, the form is made up of two nestable units which assume upper and lower positions as shown in FIGS. 7 and 8, or side-by-side position, not illustrated.

Turning now to FIGS. 1-5, an erectable, blank concrete form unit is illustrated and it comprises primary front and rear panels 20 and 22, a secondary panel 24 which is interconnected to the primary panels 20 and 22 by parallel lines of weakness 26 and which, when the form is erected, constitutes the first end wall which engages the pool wall flanges and which also spaces the front and rear walls 20 and 22 from one another. A pair of tertiary panels 28, 30 are connected by lines of weakness 32 to panels 20 and 22 respectively. Panel 28 is provided with a pair of tongues 34 which, when the form unit is erected, are received in slots 36 in tertiary panel 30. Panel 30 has tongues 38 that are received in slots 40 in primary panel 20, when the form is erected.

Secondary panel 24 is provided with an elongated slot 42 and panels 20 and 22 are also provided with a slot 44 located generally centrally thereof. Panels 20 and 22 are also provided with end panels 46, 48 as shown and, when two form units are slidably joined together as in FIGS. 7 and 8, panels 46, 48 on one unit overlap with those on the adjacent unit to provide extra strength in the combined units at this point, the end walls 24, 28 of the separate units abutting one another as shown in FIG. 7.

Figure 7:
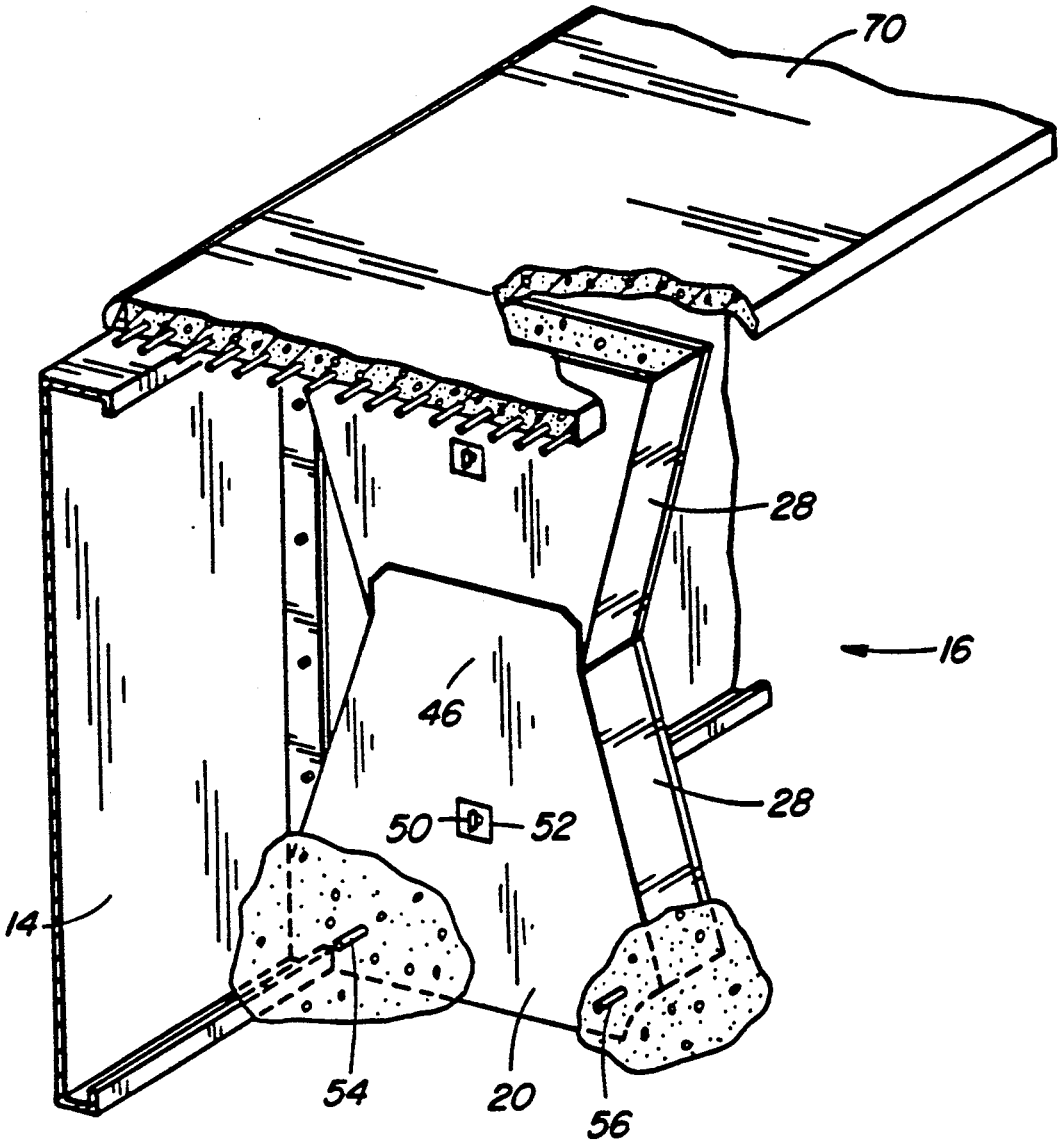
FIG. 7 is a perspective view showing a pool wall support and brace member illustrating its relationship to a pool wall and a perimeter deck.
Figure 8:
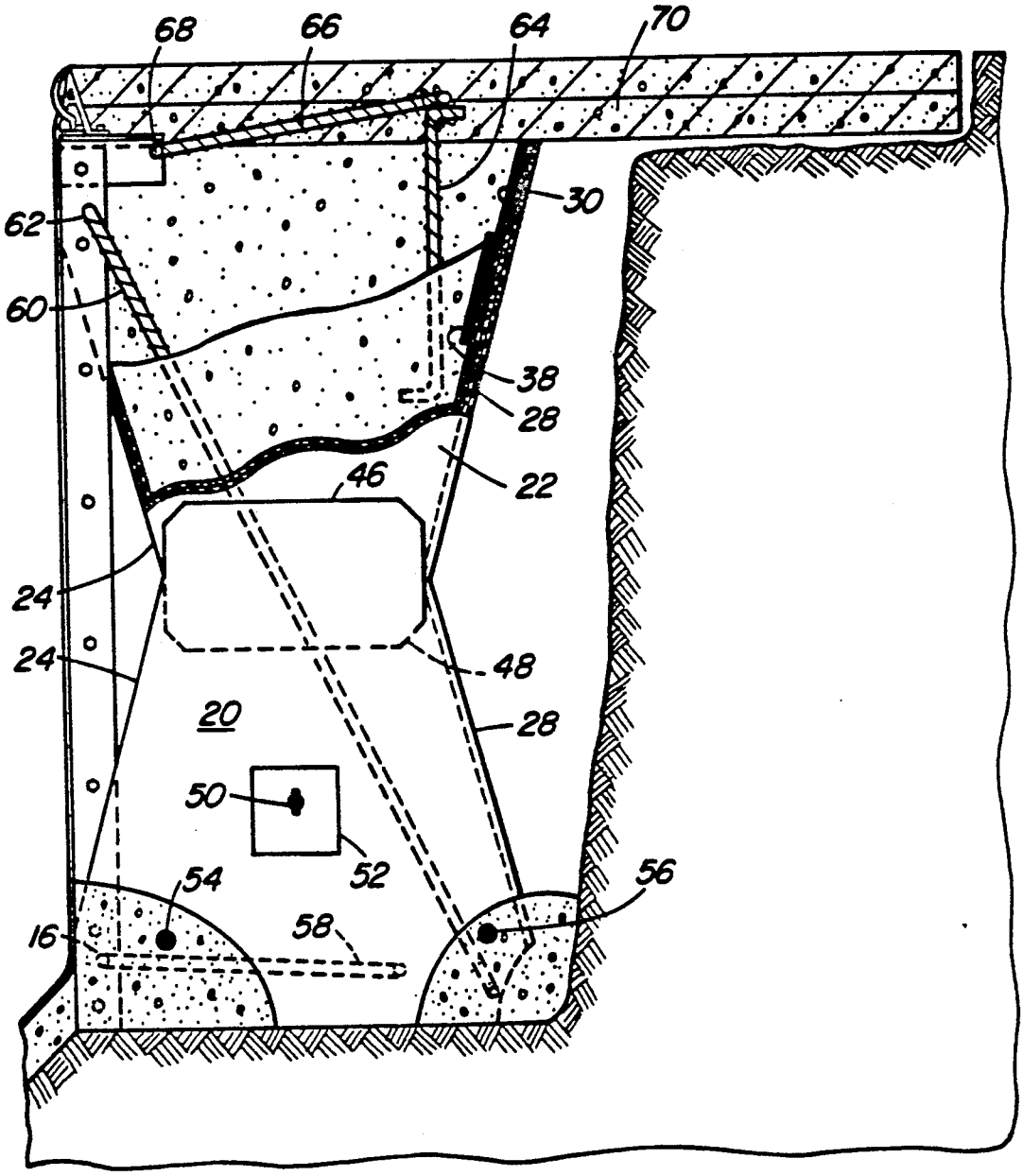
FIG. 8 is a side view, partly in section, of the pool wall brace and support member further illustrating its connections to the concrete deck and pool wall structure.

FIGS. 7 and 8 illustrate a pair of form units joined together in end-to-end relation with the panels 46, 48 overlapping one another and arranged so that the slotted side walls 24 of the upper and lower units are adjacent one another and the plain side walls 28 of both units are adjacent one another.

Larger, single form units can also be utilized but it has been found that using pairs of form units joined together on the site provides for greater ease of handling, adjustments and the like.

When first located in the excavation, the form units are provided with spacing and locking bars 50 that extend through the central slots in the unit panels 20, 22 and which include load-spreading plates 52.

Lower transverse reinforcing bars 54, 56 extend through the front and rear lower quarters of the form units as shown and concrete deposits of a suitable size are located on either side of the units to provide stability and load bearing between the front area of the form and the pool wall and the lower rear area of the form and the excavation wall.

Figure 9:
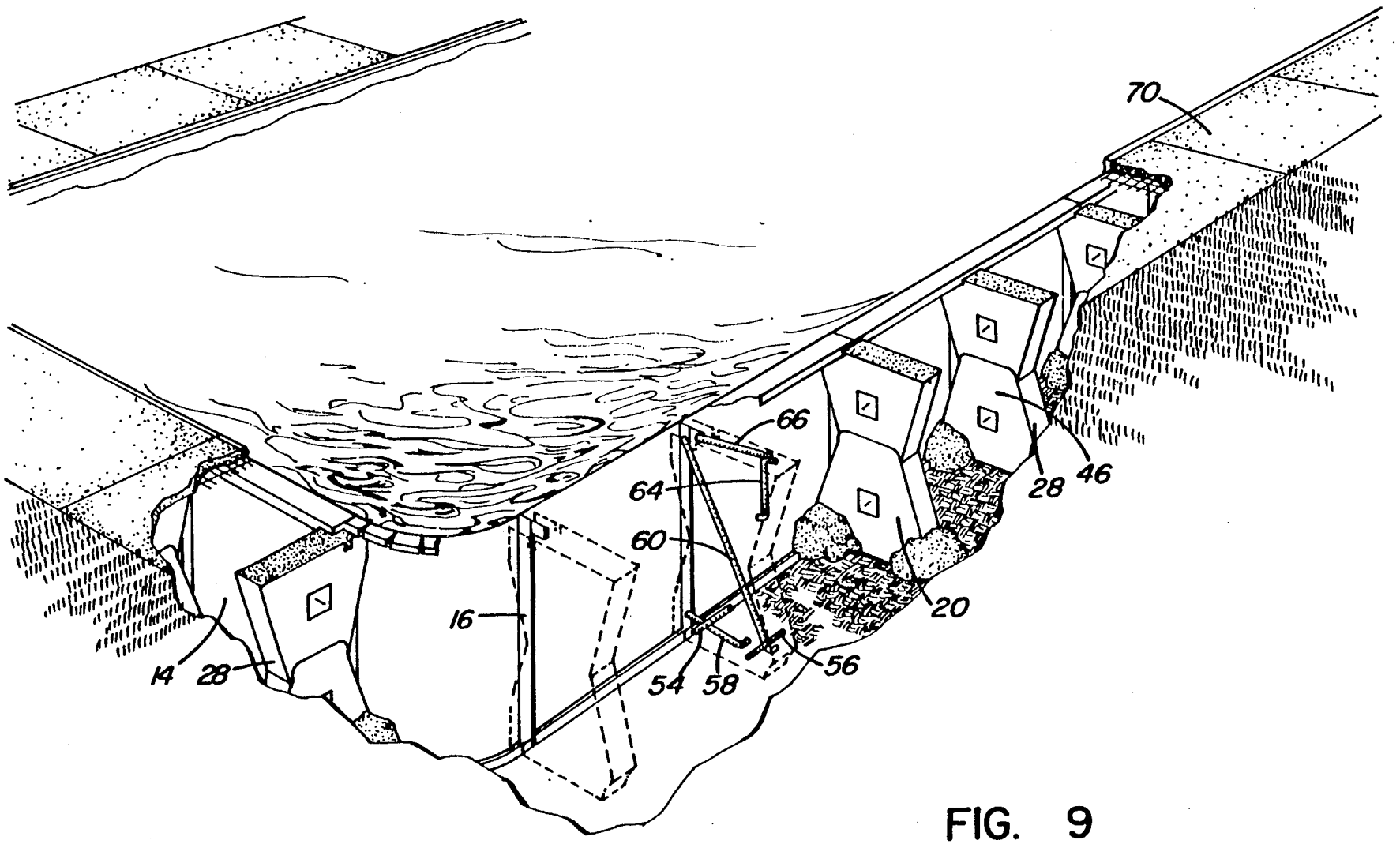
FIG. 9 is a perspective view, partly sectioned, of a completed pool incorporating the invention.

As seen in FIGS. 8 and 9, several internal reinforcing rods may be provided, a lower bar 58 interconnecting the panel flange 16 with concrete poured on the inside of the form. A longer reinforcing bar 60 is connected to the upper end of the panel flange at 62 and extends downwardly and rearwardly substantially throughout the length of the interior of the form and a pair of other bars can also be provided at the upper end of the form, bar 64 extending upwardly to protrude above the upper end of the form and bar 66 which is secured at one of its ends to the upper end of bar 64, its other end being interconnected to the top of the panel flange at 68.

It will be appreciated that, after the form has been located, connected to the pool wall panel flanges and filled with concrete, an upper perimeter deck 70 is poured and is interconnected with the upper end of the form through the reinforcing bar means 64 and 66.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

The embodiments of the invention in which an exclusive property or privilege is claimed are defined as follows:

1. A swimming pool wall structure comprising:

a plurality of pool wall panels containing terminal end edges, said panels secured together in end-to-end relation to define the perimeter of said pool, flanges on the terminal end edges of each of said panels for securing to juxtaposed flanges on adjoining panels, said flanges extending generally normal to, and outwardly of, said pool wall; and a plurality of members for supporting and bracing the pool wall, said members spaced about the outer perimeter of said wall structure, each of said members comprising a concrete form configured to accept at least portions of said flanges of said panels, each said concrete form comprising front and rear walls spaced by side walls and open at the ends thereof; and slots in one of said side walls for receiving said portions of said flanges of the pool wall panels, whereby concrete poured into said form encompasses said portions of said flanges.

2. The wall structure according to claim 1, wherein each said concrete form comprises a pair of concrete form units each having said front and rear walls spaced by said side walls connected thereto to define said open ends of said form unit, end panel portions co-planar with and extending outwardly of one end of said front and rear walls of each form unit, said end panel portions on one of said form units slidably receiving said end panel portions on a corresponding end of the other of said pair of form units in an opposite direction.

* * * * *

UNITED STATES PATENT AND TRADEMARK OFFICE

CERTIFICATE OF CORRECTION

PATENT NO. : 5,325,644
DATED : July 5, 1994
INVENTOR(S) : KERRY J. CORNELIUS

It is certified that error appears in the above-indentified patent and that said Letters Patent is hereby corrected as shown below:

On the Title Page, the following information should be inserted:

[30] Foreign Application Priority Data
April 16, 1992 [CA] Canada.....2,066,339-1

Signed and Sealed this

Twenty-eight Day of February, 1995

Bruce Lehman

*Attest:*

BRUCE LEHMAN

*Attesting Officer*

*Commissioner of Patents and Trademarks*